United States Patent [19]

Meier

[11] 3,968,909

[45] July 13, 1976

[54] SLIDE CLOSURE FOR METALLURGICAL VESSELS

[75] Inventor: Ernst Meier, Kilchberg, Switzerland

[73] Assignee: Stopinc Aktiengesellschaft, Zug, Switzerland

[22] Filed: May 13, 1975

[21] Appl. No.: 577,071

[30] Foreign Application Priority Data

May 20, 1974 Germany ..... 2424512

[52] U.S. Cl. ..... 222/600; 222/512; 251/144

[51] Int. Cl.² ..... B22D 41/08; B67D 3/00

[58] Field of Search ..... 222/504, 512, 561, DIG. 7, 222/600; 251/144

[56] References Cited

UNITED STATES PATENTS 3,511,261 5/1970 Bick et al. ..... 222/561 X 3,856,189 12/1974 Meier ..... 222/561 X

*Primary Examiner*—Robert B. Reeves
*Assistant Examiner*—David A. Scherbel
*Attorney, Agent, or Firm*—Wenderoth, Lind & Ponack

[57] ABSTRACT

A slide closure includes a housing, a fixed refractory plate positioned in the housing by a metal holding frame, a refractory slide plate positioned for sliding movement within the housing by a metal slide, and a housing closure closing the housing and having spaced rails for supporting the slide. Each side of the slide has a pair of projections contacting one rail. Each pair of projections is spaced by a distance substantially equal to the rail spacing. The holding frame is pivotally attached at a first end thereof to the housing and has at a second end thereof a stepped portion contacting the housing.

3 Claims, 4 Drawing Figures

SLIDE CLOSURE FOR METALLURGICAL VESSELS

BACKGROUND OF THE INVENTION

The present invention relates to a slide closure for metallurgical vessels, in particular steel pouring vessels of the type including a housing attached to the bottom of the vessel and positioning therein a refractory apertured fixed plate, possibly by means of a metallic holding frame, the housing also having positioned therein a metallic slide which carries a refractory apertured slide plate. The slide is displaceably supported by means of sliding surfaces on rails of a housing cover which closes the bottom of the housing.

As is well known, slide closures of the above-mentioned type are employed for opening, throttling and closing the spout of metallurgical vessels. The slide plate with a passage therethrough is displaced with respect to a passage extending through the fixed plate arranged above the slide plate. The two refractory plates, together with the inlet and outlet sleeves of the closure, are subjected to unusually high thermal, chemcial and mechanical stresses, particularly in the vicinity of the through-flow passages. In addition to an unsatisfactorily short useful life, which in the case of a steel pouring operation frequently lasts only for a single emptying of the vessel, the stresses cause difficulties with regard to operational reliability and saftey of the vessel.

Considerable efforts have been exerted to counteract these disadvantages. Thus, the refractory material of the plates has been improved. Especially with regard to steel melts, plates carefully produced, e.g. from highly aluminiferous material are particularly resistant to thermal and chemical stresses. On the other hand, until the present time it has not been possible to avoid destruction of the plates due more or less to mechanical stresses.

Protracted observations allow the assumption that the mechanical stresses which destroy the fixed plate and the slide plate result from the unavoidably differential thermal expansion of the two plates during the pouring operation, since the plates in the areas of the passages therethrough are subjected to considerably higher expansion due to the higher temperatures prevailing in such areas than at the edges of the plates. Accordingly, the plates each tend to develop a convex curvature. This unavoidable expansion increases the tendency of reciprocal clamping or locking between the fixed plate holding frame and the slide plate carrying slide in the slide housing. This clamping provides for a leakage free sailing between the two reciprocally contacting sliding surfaces of the plates. In addition to the above-mentioned thermal and chemical stresses, high local compressive stresses occur in the areas of the passages of the plates owing to the expansion of the plates, and also due to the above-mentioned clamping or locking of the plates. These compressive stresses exert a decisive negative effect on the useful life of the plates, and by jamming the plates endanger the operational capacity and reliability of the slide closure.

This relationship between local expansion and locking, as well as their effects, was not known until the present time. Among men skilled in the art, there prevailed the uniform opinion that the elimination of leakage in the closure, which is absolutely required for reliable operation, could be achieved only through the provision of maximum rigidity in the structure of the slide and of the fixed plate holding frame in the area of the passages through the plates.

Known systems for preliminary tensioning or prestressing of the fixed plate and the slide plate in the slide housing, effected by means of the housing cover with the interposition of springs, exclusively take into account the general thermal expansion of the parts of the slide closure, but do not take into account the differential thermal expansion of the plates, which has been recognized as being a decisive importance.

SUMMARY OF THE INVENTION

With the above discussion in mind, it is the object of the present invention to increase the useful life and operational reliability and safety of the fixed plate and the slide plate of a slide closure through the structural improvement of the metallic parts of the slide closure.

This object is achieved in accordance with the present invention by providing that the metallic slide for the slide plate and/or the metallic holding frame for the fixed plate rest on bearings spaced from the passages through the plates, such that between these bearings the frames are constructed to be self supporting and are capable of absorbing thermal expansion with elastic flexibility. Both the metallic fixed plate holding frame and the metallic slide, which carries the slide plate, thus possess a sufficient elastic flexibility for absorbing the thermal expansion of the plates occuring substantially in the central areas thereof. The plates are subjected to a slight bending until the curvature on the mutually contacting sliding surfaces of the plates, which curvature is caused by expansion around the passages, is at least for the most part compensated. While maintaining a leakage free seal between the plate while allowing displacement of the slide plate with respect to the fixed plate, the arrangement of the invention substantially reduces the increased compressive stressing of the plate in the area of passage, which stressing is caused by the thermal expansion. This improves the service life of the plates and increases the general reliability and safety of the closure.

It is within the scope of the invention to provide the above discussed elastic support only for the slide for the slide plate, or only for the holding frame for the fixed plate, However, an arrangement wherein the slide and the holding frame are constructed to possess approximately identical elastic flexure characteristics under the influence of the forces of thermal expansion is most preferable, particularly for slide closures of large dimensions.

The metallic slide, at the ends of the two longitudinal slides thereof, advantageously possesses projections comprising sliding surfaces for sliding contact with sliding rails of the housing cover. Further advantageously, the holding frame is fastened at one end thereof by a hinge type fastening device in a recess of the housing, and at the other end thereof the frame has a stepped surface which contacts a stepped section on the inner surface of the housing. This structural arrangement is simple and can be provided at a low cost.

In a particularly preferred embodiment, the projections of the slide and the sliding rails have wear resistant mutually contacting sliding surfaces.

BRIEF DESCRIPTION OF THE DRAWINGS

Other objects and features of the invention will be explained in the following description by way of example with reference to the attached drawings, wherein.

DETAILED DESCRIPTION OF THE INVENTION

Figure 2:
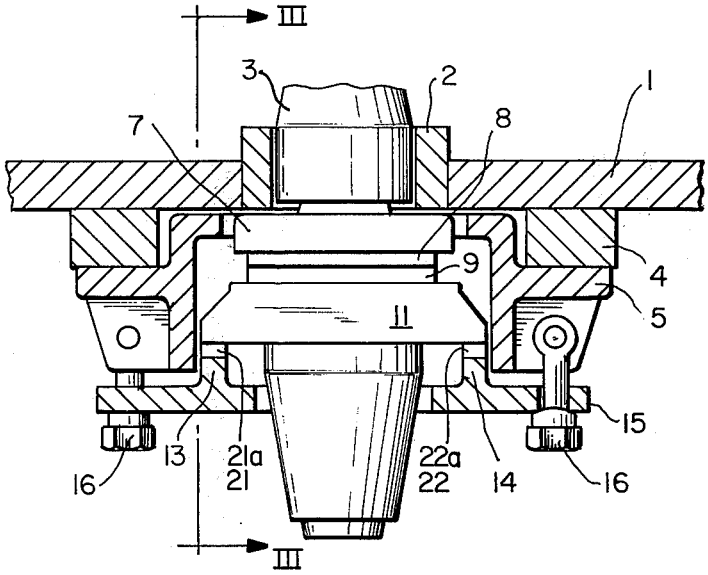
FIG. 2 is a section taken along the line II—II of FIG. 1.
Figure 3:
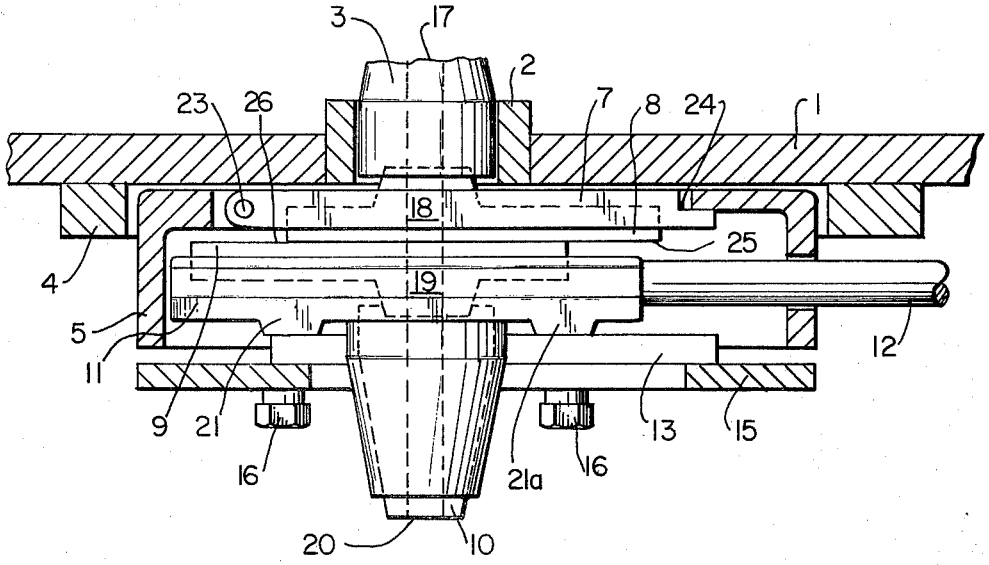
FIG. 3 is a section taken along the line III—III of FIG. 2.

In the drawings, numeral 1 indicates the bottom of a metal jacket of a metallurgical vessel. Jacket 1 has therein an opening for receipt of the refractory parts of the spout, which opening is framed by a metallic ring 2. Such refractory parts include an inlet sleeve 3 which is shown in part in FIGS. 2 and 3, while the spout brick surrounding the inlet sleeve and the refractory lining of the vessel have been omitted for the sake of simplicity and clarity of illustration.

The outer surface of sheet metal jacket 1 has an attachment frame 4 to which a slide housing 5 is removably fastened by means such as stud bolts 6. In the slide housing 5 are mounted a holding frame 7, having fixed thereto by mortar an apertured fixed plate 8, and a slide 11 having fixed thereto by mortar an apertured slide plate 9 and an outlet sleeve 10. Slide 11 is mounted for displacement along rails 13 and 14 of a housing cover 15. Displacement of slide 11 along rails 13 and 14 is achieved by means of a drive that acts on a slide rod 12. Cover 15 is attached to housing 5 with hinged bolts 16 and is employed, together with bolts 16, for fastening fixed plate 8, slide plate 9, holding frame 7 and slide 11 in housing 5, as required for operation. The drawings show slide 11 in the fully opened position, whereat passages 17, 18, 19, and 20 of inlet sleeve 3, fixed plate 8, slide 9, and outlet sleeve 10, respectively, are aligned.

Sliding rails 13 and 14 are spaced by a distance greater than the width of plates 8 and 9, and are parallel and extend longitudinally in the direction of displacement of slide 11. The outer longitudinal sides of rails 13 and 14 are positioned within housing 5. Slide 11 contacts each rail 13 and 14 with two sliding projections 21 and 21*a* and 22 and 22*a*, respectively. In the illustrated embodiment projections 21 and 22 are spaced in the longitudinal direction of the rails from projections 21*a* and 22*a*, respectively, by a distance which corresponds approximately to the space between rails 13 and 14. Thus, sliding projections 21, and 21*a* and 22, 22*a* from the corner points of a rectangle that is substantially equilateral. Through-flow passage 19 of slide plate 9 is positioned in the center of such rectangle. This arrangement allows for the expansion forces originating in the area of the passage 19 of slide plate 9 which act on the slide.

Also, fixed plate holding frame 7 is supported in a flexible manner. At a longitudinal end thereof frame 7 is hinged to housing 5 by means of a hinge 23, while the other longitudinal end of frame 7 has a stepped surface 24 which contacts the inner surface of housing 5. Otherwise, holding frame 7 is free of abutments, so that it is elastically flexible with respect to expansion forces originating from fixed plate 8 in a manner similar to that of slide 11 described above.

When the slide closure is cold, planar ground sliding surfaces 25 and 26 of plates 8 and 9, respectively, are in contact and fully cover each other, i.e. are in a closed position, that complete tightness is obtained. When plates 8 and 9 are strongly heated around passages 18 and 19, respectively, the resultant thermal expansion produces a thickening of a few tenths of a millimeter in such closed position in the case of average sized slide closures. Accordingly, if left unstressed, sliding surfaces 25 and 26 would no longer be plane, but tend to be slightly convexly curved. Such curvature cannot be eliminated through the application of direct compressive pressure of any magnitude. Rather, the sliding surfaces 25 and 26 can be made planar again only by a suitable bending of plates 8 and 9, respectively. Such bending of plates 8 and 9 is possible, in accordance with the invention, since the components 7 and 11, which respectively support plates 8 and 9, can be bent to the same extent as the plates.

Further, it can be seen that a satisfactory correction of the plate curvature can only take place when a symmetric bending of slide 11 and holding frame 7 is achieved. Only in such a case can plates 8 and 9 be returned to their position of full reciprocal contact, i.e. a position of tight abutment of their sliding surfaces 25 and 26, and also have the planar configuration of such surfaces be silmultaneously restored. If only slide 11 is bent, while holding frame 7 is not bent or is bent only to a quite small extent or in an opposite direction, the abutment of the surfaces 25 and 26 is achieved, but one of the two surfaces will be slightly convex and the other will be slightly concave. Although such a state is not optimal, the closure may be quite operational, if the curvature is very small.

Figure 1:
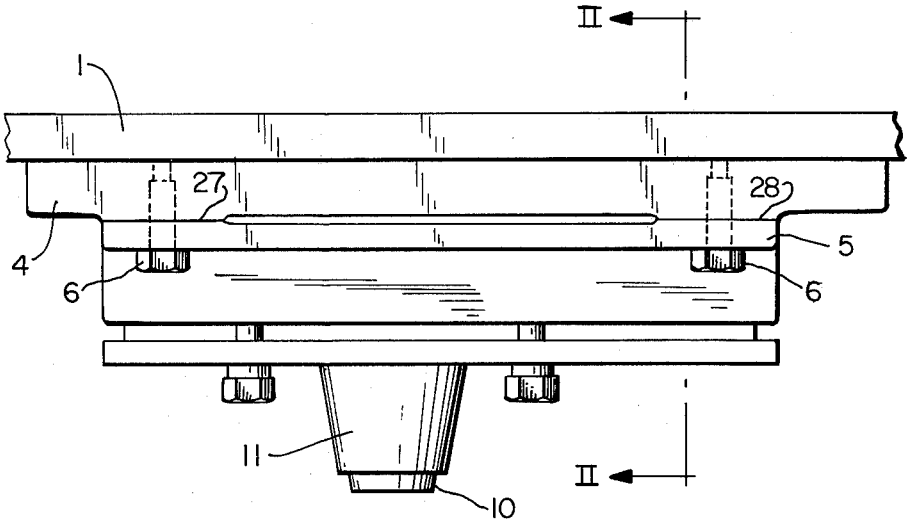
FIG. 1 is an elevation view of a slide closure in accordance with the invention.

As shown in FIG. 1, slide housing 5 contacts attachment frame 4 preferrably only at spaced points 27 and 28, whereat fastening bolts 6 are positioned. The entire closure is thus protected against the forces and expansion which may be produced through a warping of the metal due to a local heating of metal jacket 1.

Figure 4:
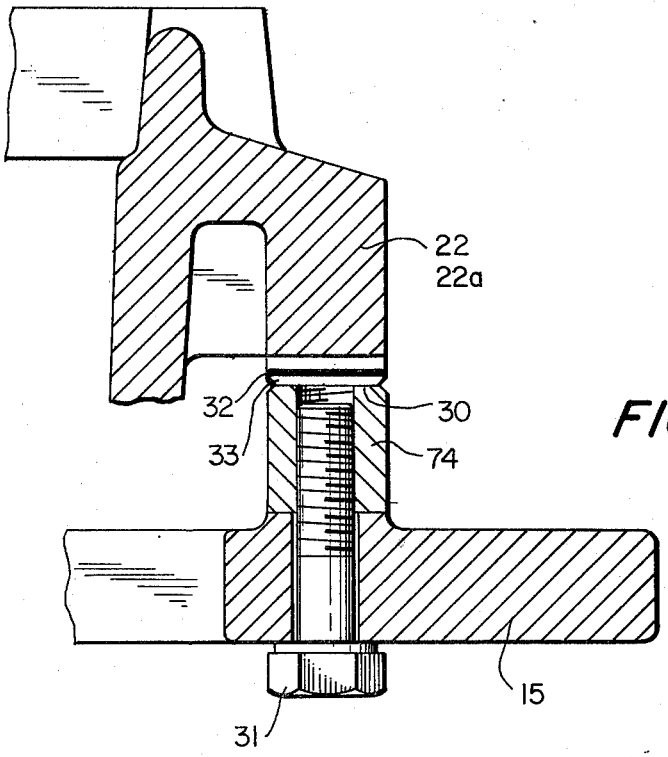
FIG. 4 is an enlarged partial section of a portion of a modification of FIG. 2.

In the modification of FIG. 4, sliding rails 13 and 14 (of which only rail 14 is shown for the sake of clarity and simplicity) are hardened to reduce the wear thereof. Advantageously, rails 13 and 14 are ionitrided or nitrided. In order to make the harding possible, hardened sliding rails 13 and 14 are detachably fastened to cover 15 by means of screws 31. Further, it is useful to coat projections 21, 21*a* and 22, 22*a* with coating 30 through a building up welding operation, e.g. with hard carbide, preferably with an intermediate layer 32 of lesser hardness and a harder cover layer 33.

Various changes and modifications may be made to the specific sturctural arrangements discussed above without departing from the scope of the invention.

What is claimed is:

1. In a slide closure device of the type including a housing attached to the bottom of a vessel having an outlet opening, a fixed refractory plate fixedly positioned in said housing by means of a metal holding frame and having an aperture aligned with said outlet opening, a refractory slide plate supported on a metal slide within said housing and having an aperture selectively alignable with said aperture of said fixed plate, a housing cover closing the bottom of said housing and having rails for supporting said slide, and means for moving said slide and said slide plate along said rails to selectively align said slide plate aperture with said fixed plate aperture, the improvement wherein:

each lateral side of said slide has two projections extending downwardly therefrom into contact with one of said rails, said two projections on each said lateral side of said slide being spaced from each other by a distance substantially equal to the distance between said rails.

2. The improvement claimed in claim 1, wherein mutual contacting surfaces of said projections and said rails are wear resistant hardened surfaces.

3. The improvement claimed in claim 1, wherein said metal holding frame is pivotally attached at a first end thereof to said housing, and has at a second end thereof a stepped edge abutting said housing.

* * * * *